United States Patent [19]

Balland

[11] 4,371,373

[45] Feb. 1, 1983

[54] CHLORIDE OXIDATION OF DYES IN VAT AND SULFUR DYED TEXTILES

[75] Inventor: Jean Balland, Chateaurenault, France

[73] Assignee: Manufacture de Produits Chimiques Protex, Paris, France

[21] Appl. No.: 784

[22] Filed: Jan. 3, 1979

[51] Int. Cl.[3] ..... D06P 1/24; D06P 1/30; D06P 5/00

[52] U.S. Cl. ..... 8/650; 8/651; 8/652

[58] Field of Search ..... 8/34, 37, 32, 33, 49, 8/650, 651, 652

[56] References Cited

U.S. PATENT DOCUMENTS

| | | | |
|---|---|---|---|
| 1,905,346 | 4/1933 | Dreyfus et al. | 8/37 UX |
| 2,382,188 | 8/1945 | Vincent et al. | 8/34 |
| 3,369,855 | 2/1968 | Hartmark et al. | 8/34 |

FOREIGN PATENT DOCUMENTS

| | | | |
|---|---|---|---|
| 877277 | 12/1942 | France | 8/34 |
| 918494 | 2/1947 | France | 8/34 |
| 1119486 | 6/1956 | France | 8/34 |
| 2103614 | 4/1972 | France | 8/34 |
| 423709 | 5/1967 | Switzerland | 8/34 |

OTHER PUBLICATIONS

Heid et al., Melliand Textilberichte, vol. 54, pp. 1314 to 1328, (1973).

*Primary Examiner*—Floyd D. Higel
*Attorney, Agent, or Firm*—Browdy and Neimark

[57] ABSTRACT

Oxidation of dyeings with reduced vat and sulfur dyes, is accomplished in an improved manner with sodium chlorite under acid conditions of preferably pH 4.5–6 at 30°–65° C. in the presence of chelating agents which prevent the release of chlorine or chlorine compounds, such chelating agents being selected from derivatives of amino carboxylic acids, such as EDTA, and hydroxyalkane phosphonic acids.

10 Claims, No Drawings

CHLORIDE OXIDATION OF DYES IN VAT AND SULFUR DYED TEXTILES

FIELD OF INVENTION

This invention relates to the oxidation with alkaline metal chlorites, and especially sodium chlorite, of dyed textiles which have been dyed with dyes, such as vat dyes or sulfur dyes, in their reduced forms.

BACKGROUND OF THE INVENTION

Of the compounds now recommended to perform such oxidation there can be mentioned alkaline peroxides, hydrogen peroxide and alkaline bichromates. Use of alkaline peroxides or hydrogen peroxide, however, often cause certain overoxidation phenomena to occur particularly in certain dyes belonging to the class of sulfur dyes. Use of bichromates often leads to a notable fading of the shades; further, it involves a pollution of the effluent because of the presence of chrominum salts in the waste waters.

Therefore, it has been proposed to use, as oxidation agents, alkaline metals chlorites and especially sodium chlorite whose use does not give rise to any phenomenon of overoxidation or dulling of the shades. However, it is known that the use of sodium chlorite as an oxidation agent requires the use of this compound at a relatively alkaline pH range; actually, it is imperative in this application to avoid any decomposition of the chlorite solution, which decomposition can occur very rapidly when working in an acid pH zone, at the usual application temperatures, generally close to or greater than 50° C. The chlorine or chlorine compounds that result from the decomposition of alkaline chlorites run the risk of deeply modifying the shades of the dyes applied, and particularly of sulfur dyes.

It is known, on the other hand, that respecting the alkaline conditions inevitably leads to a reduction of the effectiveness of the oxidizing treatment because of the relatively much smaller oxidizing power of the chlorite in an alkaline medium. It is necessary then to perform the oxidation treatments at high temperatures, often greater than 80° C., also at the same time maintaining oxidation periods which are necessarily too long.

SUMMARY OF THE INVENTION

It has now been discovered that it is possible to perform the desired oxidation at the preferred acid pH range between 3.5 and 6.5 and preferably between 4.5 and 6 and at temperatures between 0° and 90° C. and preferably between 30° and 65° C., in an acid medium, without releasing chlorine or chlorine derivatives, if certain chelating agents are added to the oxidation bath. Use of chlorite in the acid medium, for oxidation of dyeings in vat dyes or sulfur dyes, is therefore made possible without causing the slightest alteration of the dyeing characteristics of the oxidized dyes.

This invention therefore has for an object a process of dyeing made by application, in reduced form, of dye materials such as vat dyes or sulfur dyes with alkaline metal chlorites and particularly sodium chlorite in an acid medium, according to which chelating agents are added to the chlorite bath.

DETAILED DESCRIPTION OF EMBODIMENTS

According to a characteristic of the invention, these chelating agents are selected from aminopolycarboxyl acid derivatives. Of the aminopolycarboxyl acids particularly suited for practicing the invention, there can be mentioned alkali metals, alkaline earth metals or amines of ethylenediaminotetraacetic acid, diethylene triaminopentaacetic acid, nitrilotriacetic acid, N-hydroxyethylenediamino-triacetic acid and diaminopropanol tetraacetic acid.

According to another characteristic of the invention, the chelating agents are selected from the derivatives of hydroxy-alkane-phosphonic acids. The derivatives of hydroxy-alkane-phosphonic acids are advantageously compounds derived from C1 to C4 hydrocarbons, such as the salts of hydroxyethane-1, 1-diphosphonic acid or the salts of 1-hydroxy-1, 1, 3-triphosphonic acid.

Besides the fact of preventing any alteration of the dyeing characteristics, the process according to the invention makes possible a considerable improvement of the oxidation rate and a clear reduction of the treatment temperature.

It has been further found that the chelating agents mentioned above exhibit a good stability in relatively concentrated solutions of sodium chlorite. Thus it is possible to achieve concentrated formulations of sodium chlorite and chelating agent, making possible the simultaneous introduction to these two compounds in the oxidation bath and guaranteeing a precise portioning of each of the compounds.

The amount of the above derivatives that should be introduced into the oxidation baths can vary in large proportions depending on the conditions adopted. In a general way, however, this amount will preferably be between 50 and 200% by weight in relation to the amount of chlorite introduced into the baths.

The examples of application, given below by way of indicative and non-limiting illustration, will make it possible to define the possibilities of the invention more concretely. In these examples, all the concentrations are expressed in percentage in relation to the weight of the fabric.

EXAMPLE 1

A previously desized and bleached cotton fabric was dyed with a sulfur dye, applied by the dyeing process described below:

- 3% of a blue dye referenced in the Color Index as Sulphur Blue 7
- 3% sodium carbonate
- 5% sodium sulfide
- 10% sodium chloride.

After dyeing was performed for 90 minutes at a temperature of 98° C., the sample was quickly rinsed in cold water then treated for 5 minutes in an aqueous oxidation bath having the following composition:

- 1% of an 80% sodium chlorite solution
- 0.5% of the tetrasodium salt of ethylene diaminotetraacetic acid (EDTA)

The temperature of the oxidation bath was maintained at 60° C. and the pH adjusted to 5 by addition of acetic acid.

After treatment, a perfectly uniform coloring was obtained the tinctorial characteristics of which corresponded perfectly to the standards of the dye used.

Performed under the same conditions, but in the absence of the EDTA salt in the oxidizing bath, the sample obtained showed a very considerable alteration of the shade, reflecting a practically total deterioration of the coloring initially achieved.

EXAMPLE 2

The dyeing process carried out was identical with that of example 1 but the blue dye was replaced by a brown dye referenced in the Color Index as Sulphur Brown 15. After dyeing, the samples were oxidized for 5 minutes at a temperature of 60° C. with the following baths, the pH being adjusted to 5 by the addition of acetic acid:

(a) 1% of 80% sodium chlorite;

(b) 1% of 80% sodium chlorite to which was added 0.2% of the trisodium salt of nitrilotriacetic acid;

(c) 1% of 80% sodium chlorite to which was added 0.7% of the trisodium salt of nitrilotriacetic acid.

After treatment, the following results were observed:

bath a: very considerable destruction of the dyeing material.

bath b: partial but very clearly perceptible alteration of the coloring achieved.

bath c: coloring perfectly conformed to the standards of the dye used.

EXAMPLE 3

In this example, the operation was performed on cotton samples previously dyed with a vat dye, referenced in the Color Index under the name Vat Brown 53 and used at 2% by the exhaust dyeing process in a reduced vat. After dyeing, the samples were oxidized for 5 minutes at a temperature of 60° C. with the following baths, the pH of the baths having been adjusted to 5 by addition of acetic acid:

(a) 1% of 80% sodium chlorite (b) 1% of 80% sodium chlorite to which was added 0.5% of the pentasodium salt of diethylenetriaminopentaacetic acid.

After treatment, the results showed a notable degradation of the shade of the sample oxidized in bath (a) but as in the previous examples the sample coming from bath (b) perfectly conformed to the standards of the dye.

EXAMPLE 4

The process carried out was identical with example 1. Oxidation of the dyeing in this case was performed by operating under the following conditions:

Bath (a) 1% of 80% sodium chlorite to which was added 0.5% of tetrasodium salt of ethylenediaminotetraacetic acid;
pH 5.5 by addition of acetic acid;
temperature: 50° C.

Bath (b) 1% of 80% sodium chlorite;
pH 9.5 by addition of sodium carbonate;
temperature: 50° C.

After treatment, identical colorings were obtained corresponding perfectly to the standards of the dye. However, during the treatment it was observed that oxidation of the sample in bath a, namely in acid medium, was obtained after about 15 seconds; the same observation made on bath b showed that oxidation in this case required more than two minutes to be complete.

EXAMPLE 5

The operation was as in example 1, the oxidation being performed under the same conditions with:

1% of 80% sodium chlorite to which was added 0.8% sodium salt of hydroxyethane 1,1 disphosphonic acid.

After treatment, a perfectly uniform coloring was obtained whose tinctorial characteristics corresponded completely to the standards of the dye used.

It will be obvious to those skilled in the art that various changes may be made without departing from the scope of the invention and the invention is not to be considered limited to what is described in the specification. For example, it will be understood that the textile can be treated in any form, e.g. yarn, woven, knitted, etc. Also, more than one chelating agent may be used in a single bath if desired, and other agents may be present in the oxidizing bath.

What is claimed is:

1. In a process of oxidation of a dyeing made by application to textiles of a vat or sulfur dye in reduced form with sodium chlorite, the improvement wherein a chelating agent which prevents the release of chlorine or chlorine compounds is added to the chlorite bath and said oxidation is carried out in an acid medium at a pH of 3.5–6.5 and a temperature of 0°–90° C., said chelating agent being an amino polycarboxylic acid salt or an hydroxyalkane phosphonic acid salt.

2. Oxidation process according to claim 1 wherein said chelating agent is an amino polycarboxylic acid salt.

3. Oxidation process according to claim 2 wherein said amino polycarboxylic acid salt is an alkali metal salt, alkaline earth metal salt or amine salt of ethylenediaminotetraacetic acid, diethylenetriaminopentaacetic acid, nitrilotriacetic acid, N-hydroxyethylene-diaminotriacetic acid or diaminopropanol tetraacetic acid.

4. Oxidation process according to claim 1 wherein said chelating agent is an hydroxyalkane phosphonic acid salt.

5. Oxidation process according to claim 4 wherein said hydroxyalkane phosphonic acid salt is a compound from C-1 to C-4 hydrocarbons.

6. A process according to claim 5 wherein said salt is a salt of hydroxyethane 1,1 diphosphonic acid or a salt of hydroxypropane 1,1,3 triphosphonic acid.

7. A process in accordance with claim 1, 2 or 4 wherein said oxidation is carried out a pH of 4.5 to 6 and a temperature of 30° to 65° C.

8. Oxidation process according to any one of claims 1 to 6 wherein the proportion of chelating agent in relation to the amount of chlorite is between 50 and 200%.

9. Oxidation process according to any one of claims 1 to 6 wherein the chelating agent is introduced in concentrated chlorite solutions.

10. An aqueous oxidation bath for textile dyeings of dyes in reduced form, consisting essentially of concentrated sodium chlorite in an acid medium containing an amount, sufficient to prevent the release of chlorine or chlorine compounds, of a chelating agent which prevents the release of chlorine or chlorine compounds, said chelating agent being an amino polycarboxylic acid salt or an hydroxyalkane phosphoric acid salt.

* * * * *